US008618387B2

(12) United States Patent
McPherson

(10) Patent No.: US 8,618,387 B2
(45) Date of Patent: Dec. 31, 2013

(54) BRACING SYSTEM FOR STRINGED INSTRUMENT

(71) Applicant: MCP IP, LLC, Sparta, WI (US)

(72) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 13/902,163

(22) Filed: May 24, 2013

(65) Prior Publication Data

US 2013/0255466 A1 Oct. 3, 2013

Related U.S. Application Data

(63) Continuation of application No. 13/210,746, filed on Aug. 16, 2011, now Pat. No. 8,450,587.

(51) Int. Cl.
*G10D 3/00* (2006.01)

(52) U.S. Cl.
USPC ..... 84/291; 84/267

(58) Field of Classification Search
USPC ..... 84/291, 267
See application file for complete search history.

(56) References Cited

U.S. PATENT DOCUMENTS

| | | | | |
|---|---|---|---|---|
| 1,768,261 | A * | 6/1930 | Larson | 84/291 |
| 4,836,076 | A * | 6/1989 | Bernier | 84/275 |
| 5,833,805 | A * | 11/1998 | Emery | 162/109 |
| 5,952,592 | A * | 9/1999 | Teel | 84/291 |
| 6,294,718 | B1 * | 9/2001 | Saunders et al. | 84/291 |
| 6,333,454 | B1 * | 12/2001 | Griffiths | 84/291 |
| 6,943,283 | B2 * | 9/2005 | McPherson | 84/291 |
| 7,268,280 | B2 * | 9/2007 | McPherson | 84/290 |
| 7,446,247 | B2 * | 11/2008 | Shellhammer | 84/291 |
| 7,531,729 | B1 * | 5/2009 | Davis et al. | 84/293 |
| 7,612,271 | B1 * | 11/2009 | Davis et al. | 84/267 |
| 7,790,970 | B2 * | 9/2010 | McPherson | 84/291 |
| 8,450,587 | B2 * | 5/2013 | McPherson | 84/291 |
| 2013/0042739 | A1 * | 2/2013 | McPherson | 84/291 |

* cited by examiner

*Primary Examiner* — Robert W Horn
(74) *Attorney, Agent, or Firm* — Vidas, Arrett & Steinkraus, P.A.

(57) ABSTRACT

A bracing structure for a soundboard for a musical instrument is disclosed, the bracing structure being a unitary sheet structure having a plurality of elongate semi-tubular elements. Each of the elongate semi-tubular elements has a length, a thickness, a width, a height and an interior resonance space. The sheet structure may be formed of two or more layers. The elongate semi-tubular elements function as traditional braces, however, the shape of the elongate semi-tubular elements may be modified to provide a desired tonal quality.

20 Claims, 4 Drawing Sheets

BRACING SYSTEM FOR STRINGED INSTRUMENT

CROSS-REFERENCE TO RELATED APPLICATIONS

This application is a Continuation application from U.S. patent application Ser. No. 13/210,746 issued as U.S. Pat. No. 8,450,587 on May 28, 2013, the contents of which is hereby incorporated by reference.

FIELD OF THE INVENTION

The present invention relates to an acoustic guitar or other stringed musical instrument having a sound box, and more particularly, the present invention relates to a unique bracing structure for the soundboard comprising a unitary structure which may be a sheet structure having a plurality of elongate semi-tubular elements defining interior resonance spaces. The elongate semi-tubular elements constitute structure which is the negative space representation of a traditional bracing structure. The interior resonance spaces enhance sound quality for the instrument.

BACKGROUND OF THE INVENTION

A typical acoustic guitar has a hollow body or sound box connected to a neck. The hollow body has a soundboard with a sound hole, a back or bottom board spaced from the soundboard, and a shaped side wall which connects between the soundboard and back board. Typically, these components are constructed of choice pieces of wood in order to produce instruments of superior quality.

The acoustic guitar has a series of strings strung at substantial tension from a bridge on the soundboard, across the soundboard proximate to a sound hole, and along the neck. The string tension creates forces which act on the soundboard and which, over time, may cause bending, cracking or other damage to the soundboard. The damage can result in structural failure and altered intonation of the acoustic guitar. As such, the guitar, notably the sound box, must be constructed in a relatively strong and stable manner, without making it to heavy or limiting its response.

In high quality acoustic guitars, the soundboard must be capable of sufficient vibration to provide superior acoustic performance while being sufficiently rigid so that it withstands the forces created by the tensioned strings. These requirements are at cross-purposes, and heretofore have been very difficult to achieve, particularly when the soundboard is constructed from a material other than choice wooden materials. The soundboard is in close union with the remaining pieces of the sound box. As such, to achieve the desired high tonal qualities, one must also address these features as well.

Prior art designs have attempted to improve upon the strength and durability of acoustic guitars without adversely affecting its playing qualities. Acoustic guitars are constructed so as to amplify the sound wave produced by the vibration of the strings, via a resonance body having a soundboard. The sound wave created by the vibrating strings is introduced into the resonance body through the bridge provided on the soundboard. Inside the resonance body, the sound wave is resounded and amplified within the resonance body. If the resonance body is not constructed correctly, the sound may be emitted in a muffled or dampened manner.

Prior art designs have also attempted to utilize a number of different types of materials for braces or to form the soundboard or other portions of the sound box. Examples of these prior art devices may be found in U.S. Pat. Nos. 6,943,283; 4,353,862; 7,612,271; 5,396,823; 4,942,013; 4,429,608; 4,836,076; 5,333,527; 6,333,454; 7,208,665; 7,678,978; 5,406,874; 5,952,592; 4,969,381; 6,664,452; 2008/0,028,910; 7,268,280; and 7,790,970 the entire contents all of which being incorporated herein by reference in their entireties.

Prior art designs have attempted to improve upon the strength and durability of acoustic guitars without adversely affecting its playing qualities. For example, U.S. Pat. No. 5,461,958 issued to Dresdner et al, and assigned to the assignee of the present application discloses an acoustic guitar assembly having a wooden soundboard with an improved soundboard bracing structure and an improved neck to body joint.

The present invention provides for a uniformly strong sound box which delivers clean, brilliant sound. The construction of the box provides for easier and more economical manufacture when state of the art equipment is used.

All U.S. patents and applications all other published documents mentioned anywhere in this application are incorporated herein by reference in their entireties.

Without limiting the scope of the invention in any way, the invention is briefly summarized in some of its aspects below.

The art referred to and/or described above is not intended to constitute an admission that any patent, publication or other information referred to herein is "prior art" with respect to this invention.

BRIEF SUMMARY OF THE INVENTION

In accordance with the invention, a sound box for an instrument is provided exhibiting a 3-D bracing system. The bracing system comprises a sheet structure comprising a plurality of elongate semi-tubular elements defining interior resonance spaces. The elongate semi-tubular elements represent the negative space which occurs following the removal of a traditional bracing structure from the sheet structure during the manufacturing process. The elongate semi-tubular elements perform the function of the braces. The sheet structure may be located on either or both of the soundboard and the bottom or back board of the sound box. The elongate semi-tubular elements may exhibit varying heights and configurations to, among other things; increase the strength of the soundboard without increasing the weight unnecessarily.

In some embodiments, the soundboard and the bottom board may be effectively interconnected via vertical struts attached to the inside of the side wall. The struts may be interconnected without any glue joints between the different struts. The interconnections preserve the desired strength without increasing the rigidity for the sound box. Further, in sound boxes where there are unnecessary constructive reinforcements, sounds tend to interfere. The present system provides a purer sound in which as many parts as possible vibrate at the same frequency.

The invention is also designed so that individual components can be machined separately, reducing costs and increasing consistency of the guitars.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
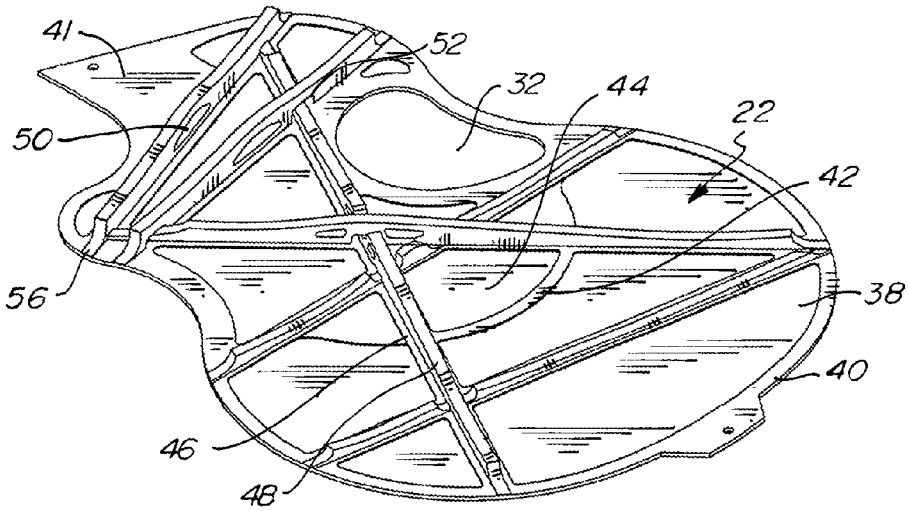
Fig.1 (PRIOR ART)
FIG. 1 is an isometric view of one embodiment of a prior art soundboard.

While this invention may be embodied in many different forms, there are shown in the drawings and described in detail herein specific embodiments of the invention. The present disclosure is an exemplification of the principles of the invention and is not intended to limit the invention to the particular embodiments illustrated.

For the purposes of this disclosure, unless otherwise indicated, identical reference numerals used in different figures refer to the same component.

Figure 2:
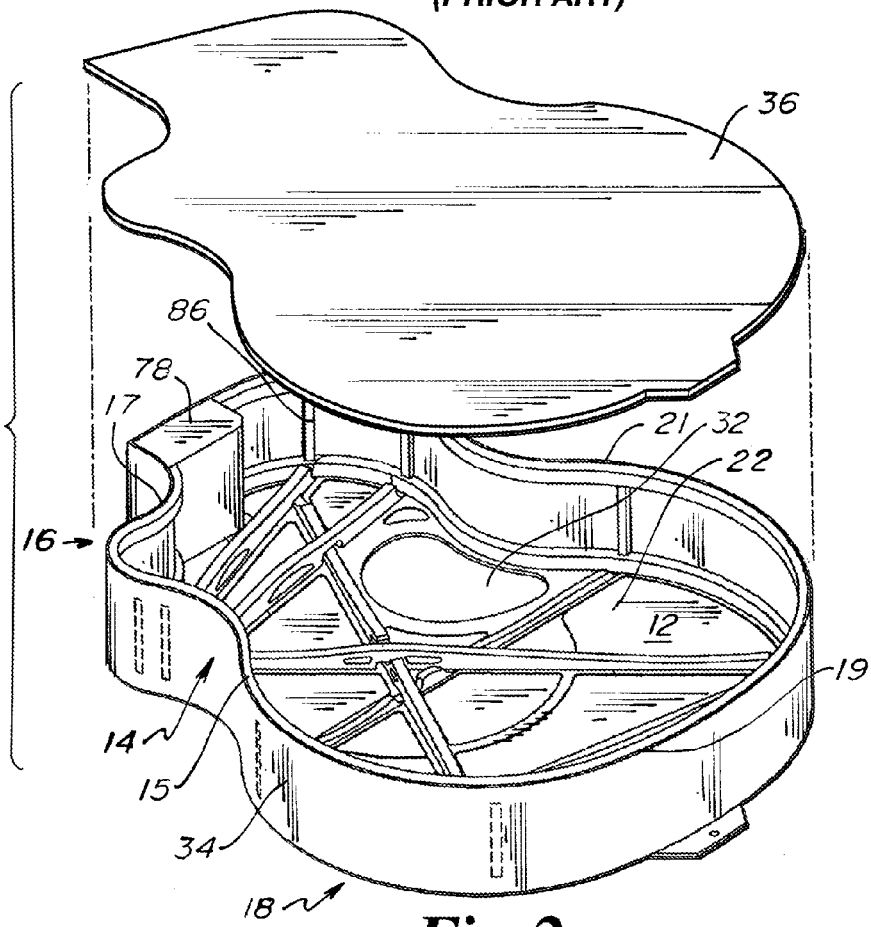
Fig.2 (PRIOR ART)
FIG. 2 is an exploded isometric view of one embodiment of a prior art sound box.

This invention relates to a bracing system in instruments using sound boxes. For purposes of description, an acoustic guitar is used for illustrative purposes. As shown in FIG. 2, guitars have a hollow guitar body or sound box 12. Body 12 has a waist generally indicated at 14 which identifies the narrowest portion or mid-section of the guitar. The portion of the guitar body above waist 14 is known as the upper bout and is generally designated at 16. The portion of the guitar body below the waist 14 is generally known as known as the lower bout and is generally designated in the figure at 18.

The top, 22, seen in FIG. 2 of guitar hollow body or sound box 12 is known as the soundboard 22. The soundboard 22 has a sound hole 32 and at its periphery, defines the edges of the upper bout 17, the lower bout 19 and the edges of upper 15 and lower 21 waist portions. The edges of the soundboard 22 are connected to a side panel or wall, and in turn the rear panel or bottom 36, to form the hollow body as is typical of guitars. As is conventional in guitars, a neck is attached to hollow body to extend from soundboard 22. A bridge is also anchored to soundboard 22 to transfer vibrations into the soundboard. Strings extend along neck and are received by bridge, thereby supporting strings over soundboard 22. Strings are attached at the distal end of the neck in any conventional manner known in the art, preferably in such a way to allow for tension adjustment of the strings.

FIG. 2 also shows the side board 34 engaged to a top soundboard 22 and a bottom board 36. The side board or wall 34 is typically one piece shaped to form the side of the body 12.

FIG. 1 in one embodiment shows a face view of the bottom or underside of the soundboard 22. The soundboard 22 may be made of multiple layers, however only one layer may be used. It should be understood that one may do the following described machining steps into the one layer embodiment in at least one embodiment, a top board (first layer 38) may be laminated with an additional layer to form a second layer 40. The additional layer preferably has its grain oriented substantially 90 degrees to the first layer 38. Certain portions of the soundboard 22 may be machined down to the first layer 38. Not all the first layer portions 38 are indicated, but are clearly identifiable. The second layer 40 may include portions which have been machined through to layer 38, while other portions are only partially machined or remain their original thickness. Not all the second layer portions 40 are indicated, but are clearly identifiable. In some embodiments a laminate bracing pattern may be seen when the soundboard is machined. The machined areas are not required to be as shown.

In at least one embodiment, portion 42 of the second layer 40 may be machined and replaced with an insert 44, to increase the stiffness of the region to support the bridge, which is attached to the top of the soundboard 22. Suitable material for insert 44 comprises a material of higher modulus than the second layer 40. Suitable materials include, but are not limited to, maple, ebony, rosewood and other woods possessing similar physical properties. This portion 42 may also remain unmachined, leaving the second layer 40 in place instead of using an insert.

In at least one embodiment, the second layer 40 may be left to form the bracing pattern or in the form of bracing tracks 46 for the braces 48. The tracks 46 may have grooves. The grooves may be sized for the elongated braces 48 to fit therein for a more secure fit. Typically, the braces 48 are adhered into the grooves. The grooves may be machined into the tracks 46. The grooves may vary in depth, however it is preferable that the grooves are not made beyond the depth of the second layer 40. This allows the braces to act bigger than they are. The grooves also allow for greater surface area hr adhesive to secure the braces 48. The braces become more a part of the soundboard 22 than extension of it. These grooves also apply to the brace patterns on the bottom board and optionally the struts on the side wall.

The second layer 40 also remains around the neck block area 41, the sound hole 32 and the brace area for greater support in those areas.

Although the thicknesses of the materials may vary, suitably first layer 38 may have an initial thickness of approximately 0.125 inch, which second layer 40 may have an initial thickness closer to 0.0625 inch.

Although the types of wood may vary, suitably first layer 8 is made of cedar, redwood, sitka spruce or ingleman spruce and second layer 40 is made of sitka spruce, cedar or maple or other woods of similar mechanical properties.

In at least one embodiment, for the soundboard 22 and/or the bottom board 36, the braces 48 are neither parallel nor perpendicular to one another. The individual braces 48 are generally continuous from their individual origination points at the edge of the soundboard 22 to their ending points at the respective opposite edge of the soundboard 22. The braces 48 may have varying heights and may be provided with elongated apertures 50 in the areas of greater heights. Due to the increase in height, the apertures 50 do not compromise the strength of the braces according to the engineering equation:

$$I = \frac{bh^3}{12}$$

As such, the braces may be lightened without sacrificing strength. Changing the profiles of the braces 48 creates more stiffness where loads are greater. It should be understood that the braces 48 may have different configurations as needed for positioning on the soundboards 22. Further, persons of skill in the art will recognize that the above equation for 1 can change according to the specific cross-sectional shape of a brace 48.

In some embodiments, certain braces 48 may also be provided with tunnels 52 and certain braces 48 are provided with valleys, which extend through the tunnels 52. These valleys and tunnels 52 allow the braces 48 to continue uninterrupted when they cross one another. This configuration allows braces to cross without breaking either's continuation.

In some embodiments, the braces 48 may also slant downward at their termination points 56. Among other reasons, this is to accommodate the side wall 34, which is adhered to the periphery of the top 22. In some embodiments, with regard to the 3-D bracing system, the braces 48 and/or struts may not be bonded together, but may be located immediately adjacent to one another. This configuration may provide strength and rigidity without sacrificing the vibration capabilities throughout the sound box. In certain embodiments, there are no rigid glue joints involving the connection of the braces and struts to dampen the vibration effect.

In some embodiments, the individual braces 48 may be made of a solid piece of wood, or other suitable material. However, the braces may also comprise a center layer, sandwiched between two outer layers. In some embodiments, the braces 48 may also comprise one or more center layers sandwiched between two outer layers. In some embodiments, the layers may be adhered together. In some embodiments, center layer may be made of a harder wood to help control stiffness, including, but not limited to, rosewood, mahogany or maple or other woods of similar stiffness. The outer layers may comprise, but are not limited to, sitka spruce, mahogany or maple or other similar materials.

In some embodiments, the bottom 36 may be made of multiple layers, however only one layer of wood is shown. Suitable materials include, but are not limited to, rosewood, koa, black walnut, black acacia, maple, mahogany, zircote and macasser ebony. As with the soundboard 22, the bottom 36 may have grooves to fittingly receive the braces 48. The grooves may be sized for the elongated braces 48 to fit therein for a more secure fit. Typically, the braces 48, which preferably are laminated pieces, are adhered into the grooves. Although the thickness may vary, preferably the total laminated width is from 0.25 to 0.375 inch. Although the wood types may vary, the laminated braces preferably are made of rosewood and sitka spruce or equivalent stiffness wood combinations.

In one embodiment, for the soundboard 22 and/or the bottom board 36, the braces 48 are neither parallel nor perpendicular to one another. The individual braces 48 are generally continuous from their individual origination points at the edge of the bottom 36 to their ending points at the respective opposite edges of the bottom 36. As with the top 22, the braces 48 may have varying heights and may be provided with elongated apertures 50 in the areas of greater heights. Due to the increase in height, the apertures 50 do not compromise the strength of the braces 48 according to the engineering equation:

$$I = \frac{bh^3}{12}$$

As such, the braces may be lightened without sacrificing strength. Changing the profiles or the configuration of the braces 48 creates more stiffness where loads are greater for either the soundboard 22 or the bottom 36, it should be understood that the braces 48 have different configurations as needed for various positions on the soundboard 22 or the bottom board 36. Further, persons of skill in the art will recognize that the above equation for 1 may change according to the specific cross-sectional shape of a brace 48 used on the bottom 36.

In at least one embodiment, when the face of the soundboard 22 is placed over the face of the bottom 36, with the upper bouts 16 and the lower bouts 18 aligned, the termination points 56 of the braces 48 of the bottom 36, are aligned in opposing fashion the termination points 56 of the braces 48 of the soundboard 22.

In at least one embodiment, more than one termination point of the soundboard 22 may match up with a termination of a single brace of the bottom 36. Each brace may have two termination points. It should be understood that some termination points in the soundboard 22, which are paired with another termination point, do not match up exactly with the opposing board's termination points. However, one of the paired termination points will match up better than the other termination point of a particular pair.

In at least one embodiment, the side wall 34 extends around the periphery of the soundboard 22. A neck block 78 is provided at one end for securement to the neck, and an end block is provided at the other end. The neck and end blocks are used for connection purposes and for support of the overall structure of the sound box. In at least one embodiment, preferably wood strips, are attached, preferably adhered, to the inside upper and lower edges of the side wall 34. The strips extend from neck block 78 to the end block. The strips provide support to the structure and provide greater surface area to connect, preferably adhere, to the soundboard 22 and the bottom 36. In some embodiments, the strips may be scored, or cut, along their length to provide flexibility so that the strips can easily conform to the side wall 34 in its tortuous path.

In some embodiments, the sound box 12 includes vertical struts 86, preferably wooded, on the inside of the side wall 34. The struts 86 provide support to the sound box as well as providing a feature of the 3-D bracing system. In some embodiments, the vertical struts may be aligned with the termination points of the braces 48. The struts 86 rise vertically from the termination points of the braces 48. It should be understood that the number of struts may be as many as needed. In alternative embodiments, the struts may be made of any suitable material.

In at least one embodiment, the bracing structure, in its complete form, creates a 3-D bracing system. The 3-D bracing system is generally the bracing system of the soundboard 22 and the bracing system of bottom board 36 interconnected by the struts 86 on the side wall 34.

In at least one embodiment, when the sound box 12 is assembled, the termination points 56 of the braces 48 of the soundboard 22 are generally above the corresponding termination point 56 of the braces 48 for the bottom board 36. The corresponding points 56 are linked by the struts to create the 3-D bracing system.

A particular, but not the exclusive, feature of the 3-D bracing system is the ability of the interconnection of the braces via the struts to disperse stress and strain throughout the system. The positioning and the configuration of the braces 48 and struts 86 provide strength and stiffness for the sound box without adding unnecessary weight, while providing for uniformity of vibration and pureness of sound.

Figure 3:
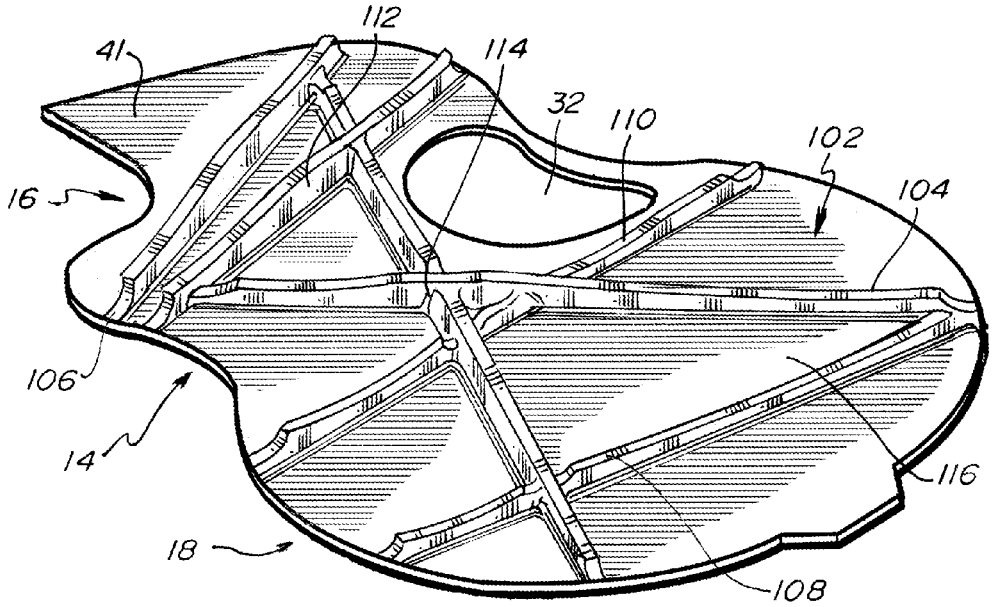
FIG. 3 is an isometric view of one embodiment of a bracing structure for a soundboard according to the invention.

In at least one embodiment of the invention as depicted in FIG. 3, the braces 48 of a traditional bracing structure for a soundboard 22 have been replaced with a sheet structure 102 having elongate semi-tubular elements 104. In some embodiments, the sheet structure 102 may be formed of fiberglass, composite, carbon fiber, kevlar, plastic, resin, and/or combinations of these or other suitable materials. In some embodiments, the material selected for the sheet structure 102 may be reinforced. The sheet structure 102 in some embodiments may be formed of layers of woven fabric, where each layer may be offset or juxtaposed relative to an adjacent layer. In some embodiments, the juxtaposed or aligned layers of woven material, which may be fiberglass cloth, may be soaked with a desired type of resin for disposition over a prepared bracing structure for soundboard 22.

In some embodiments a traditional bracing structure having a plurality of spaced apart braces 48 may be organized into a pattern, which may be used as a mold for the formation of the sheet structure 102 having elongate semi-tubular elements 104. In at least one embodiment, the traditional bracing structure having braces 48, as formed of wood or other materials, is disposed and securely positioned within a mold or form. In some embodiments, a releasing agent may then be placed upon the surface of the braces 48, and mold or form, to facilitate separation of the sheet structure 102 from the traditional braces 48 upon the completion of the molding process.

In some embodiments, the layers of woven fabric or other material may be placed over a traditional bracing structure, whereupon impregnating liquid/bonding resin or other material may be added. A plate/press having negative space recessions corresponding to the size, shape, orientation, and/or depth of the respective traditional bracing structure may then be pressed upon the liquid impregnated layers of woven fabric or other material whereupon vacuum suction may occur to remove air, followed by curing of the sheet structure 102. The plate/press element may be withdrawn, whereupon the sheet structure 102 may be removed from the surface of the traditional bracing structure having braces 48.

In at least one embodiment, a vacuum table may be utilized to apply a vacuum to the impregnated sheet of glass fiber to facilitate formation of a mold for the sheet structure 102, conforming to the identical shape of the bracing structure for the musical instrument. In at least one alternative embodiment the bracing structure will be a master die structure and a matching press structure of a die set which may be utilized to facilitate formation of the sheet structure 102.

In at least one embodiment, the mold dies for the sheet structure 102 for the 3-D bracing system, may be made according to the profile of a bracing structure which was previously formed through the use of vacuum techniques, upon fiberglass, composite, or other materials, as disposed on a prior art bracing structure.

Those skilled in the art will be readily aware of other types of molding/formation procedures, as well as alternative types of materials which may be utilized in the manufacture of the sheet structure 102 having elongate semi-tubular elements 104. In at least one embodiment, the sheet structure 102 formed of fiberglass, composite or other materials is the bracing for the interior of the soundboard 102 and/or back board 36.

In at least one embodiment, the resulting sheet structure 102 includes elongate semi-tubular elements 104 which have the same shape and configuration/pattern as the braces 48, which represent a negative internal space image of the traditional bracing structure. The elongate semi-tubular elements 104 formed of fiberglass, composite and/or other material have the properties and perform the support function in substitution for the traditional braces 48 as located on the interior side of a soundboard 22.

In at least one embodiment, the fiat portion 116 of the sheet structure 102 provides bracing for the soundboard 22. In at least one embodiment, the size, shape, depth, height, width, and configuration of the elongate semi-tubular elements 104 provide bracing for the soundboard 22. In at least one embodiment, the integral sheet structure 102 and elongate semi-tubular elements104 provide for the bracing of the soundboard 22 in substitution for the wood or other bracing components previously used in traditional bracing structures.

In at least one embodiment, the sheet structure 102 having elongate semi-tubular elements 104 may be affixed/attached, secured, and/or bonded to the interior side of a soundboard 22, for vibration in unison with the soundboard 22, to provide the desired tonal characteristics for the stringed musical instrument.

In at least one embodiment as may be seen in FIG. 3, the sheet structure 102 may conform to the shape of a soundboard 22 and include a sound hole 32, a neck block area 41, and the elongate semi-tubular elements 104 may include terminal portions 106 shaped like the terminal portions 56 of the braces 48. In at least one embodiment, the sheet structure 102 may also include an upper bout area 16, a waist area 14, and a lower bout area 18.

In at least one embodiment, the elongate semi-tubular elements 104 are formed a desired pattern, where the pattern of elongate semi-tubular elements 104 may be modified to accommodate different types of tonal qualities for the soundboard 22, as well as various strength reinforcements for the soundboard 22. In at least one embodiment, each elongate semi-tubular element 104 may include sections of raised height 108, and reduced height 110, in order to provide a desired tone or strength for the soundboard 22.

In at least one embodiment, the elongate semi-tubular elements 104 do not include tunnels 52 and/or elongate apertures 50 as utilized with conventional braces 48. In at least one embodiment, the elongate semi-tubular elements 104 have sidewalls 112 to improve the structural strength of the elongate semi-tubular elements 104. In alternative embodiments, in order to provide desired tonal qualities for the soundboard 22, openings may be placed through the solid sidewalls 112 of the elongate semi-tubular elements 104. In some embodiments, the elongate semi-tubular elements104 may also include transition areas 114 where two or more elongate semi-tubular elements 104 are joined together.

In at least one embodiment as depicted in FIG. 3, the sheet structure 102 is shaped to substantially cover the interior of the soundboard 22. It should be understood that the sheet structure 102 having the attributes identified herein may also be used on the interior of the bottom board 36. In at least one embodiment, the sound holes 32 of the soundboard 22 and the sheet structure 102 are aligned. In some embodiments, the sheet structure 102 may be trimmed along the exterior edges to conform to the desired shape for the soundboard 22. In at least one embodiment as depicted in FIG. 3 the sheet structure 102 may be secured or attached to the interior of the soundboard 22 through the use of adhesives or other commonly used affixation techniques or substances. In at least one embodiment, the materials and shape of the sheet structure 102 provide sufficient structure to the soundboard 22 to prevent cracking, bending, warping, or other load related problems following the tightening of strings from the bridge to the neck of the musical instrument.

In at least one embodiment, the sheet structure 102 includes substantially flat portions 116, and the sheet structure 102 is adhered to the interior wood layer of the soundboard 22. The elongate semi-tubular elements 104 may be integral with, and extend outwardly from, the sheet structure 102 into the internal cavity of a musical instrument following the attachment of the soundboard 22 to the side wall/board 34 as engaged to the bottom board 36.

In some embodiments the elongate semi-tubular elements 104 define elongate cavities or interior resonance spaces 118 which may be rectangular, semi-circular, or any other geometric shape which is selected to provide unique resonance properties for the musical instrument.

In some embodiments the elongate semi-tubular elements 104 correspond to the size, shape, and/or configuration of traditional braces 48 used with a soundboard 22. In other embodiments the elongate semi-tubular elements 104 may be increased or decreased in size dimension as compared to traditional braces 48 and bracing structures.

In some embodiments the internal cavities or resonance spaces 118, within the interior of the elongate semi-tubular elements 104 provide additional acoustic and tonal qualities for the soundboard 22. In some embodiments, during use of the musical instrument, vibrations are transmitted within the internal cavities or resonance spaces 118 to enhance sound transmission and the performance of the instrument.

In some embodiments, the acoustical and resonance characteristics of the soundboard 22 may be adjusted by modification of the width, height, thickness, depth, and/or shape of the sheet structure 102, elongate semi-tubular elements 104 and/or the internal cavities or resonance spaces 118. In some embodiments, the width, height, depth, thickness, and/or shape of the individual elongate semi-tubular elements 104 may gradually or dramatically change by increasing or decreasing dimensions, along the length of the elongate semi-tubular elements 104, or at certain desired locations, in order to provide the desired sound quality or tone effect.

In some embodiments the use of a sheet structure 102 as bracing for a soundboard 22 facilitates uniformity in the crafting of a soundboard 22 for a musical instrument reducing waste and improving sound quality. In some embodiments the use of a sheet structure 102 as bracing for a soundboard 22 limits the number of variables associated with the formation of a soundboard 22 for a musical instrument. Variables would include but are not necessarily limited to vibrational differences inherent in different pieces of wood used to form the traditional braces and/or soundboard 22.

Figure 4:
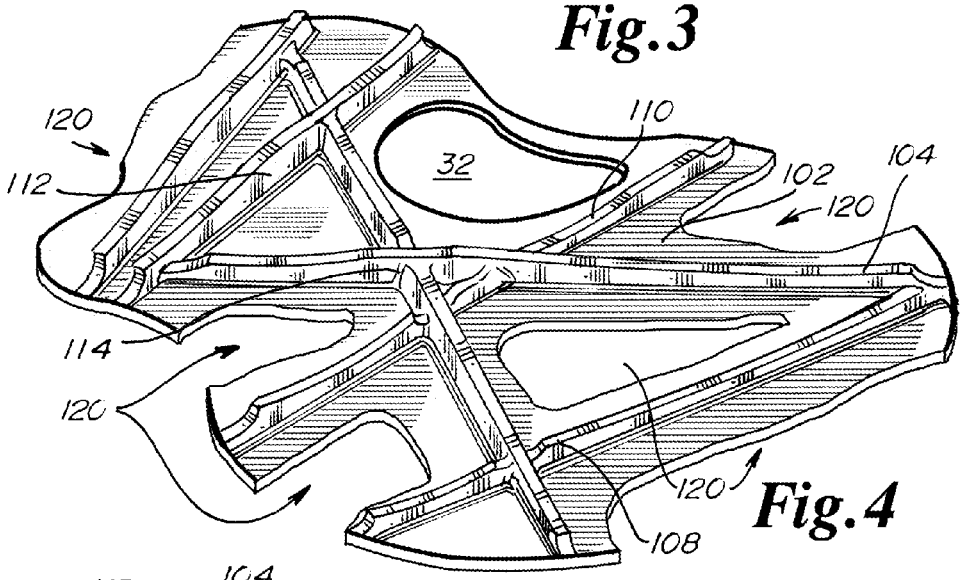
FIG. 4 is an alternative isometric view of one embodiment of a bracing structure for a soundboard according to the invention.

In at least one embodiment as depicted in FIG. 4, certain flat portions 116 of the sheet structure 102 have been removed to define voids 120. In at least one embodiment the voids 120 are disposed around the periphery of the sheet structure 102, exterior to the elongate semi-tubular elements 104. In at least one embodiment, the voids 120 are 120 are disposed between adjacent elongate semi-tubular elements 104 through the sheet structure 102. In at least one embodiment, the voids 120 may be disposed around both the periphery of the sheet structure 102 exterior to the elongate semi-tubular elements 104 and between adjacent semi-tubular elements 104. In some embodiments, the voids 120 are regularly shaped, and in other embodiments the voids 120 are irregularly shaped.

In some embodiments the voids 120 are provided to adjust/alter the tonal vibrational qualities for the soundboard 22 for the musical instrument. In at least one embodiment, the voids 120 promote vibration of the soundboard 22. In some embodiments, the number, shape, and positioning of the voids 120 may be varied in order to provide a desired tonal quality for the soundboard 22.

In some embodiments, the voids 120 do not contact or intersect with the elongate semi-tubular elements 104. In at least one embodiment, at least one void 120 may be in contact with or may pass through at least one elongate semi-tubular element 104.

Figure 5:
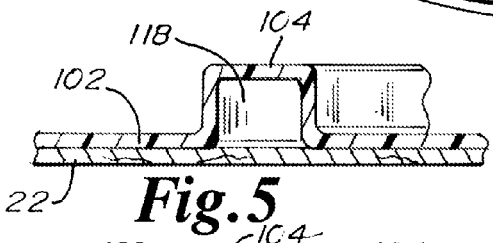
FIG. 5 is a detail partial cross-sectional side view of one embodiment of a bracing structure comprising an elongate semi-tubular element for a soundboard according to the invention.

In at least one embodiment as depicted in FIG. 5, a sheet structure 102 is disposed on a soundboard 22. A rectangular shaped elongate semi-tubular element 104 having a rectangular shaped interior cavity or resonance space 118 is integral to the sheet structure 102 on the soundboard 22.

Figure 6:
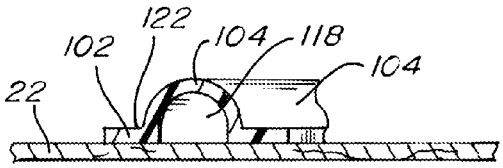
FIG. 6 is an alternative detail partial cross-sectional side view of one embodiment of a bracing structure comprising an elongate semi-tubular element for a soundboard according to the invention.

In at least one embodiment as depicted in FIG. 6, a trimmed sheet structure 102 is disposed on a soundboard 22. The trimmed sheet structure 102 may occur as a result of the inclusion avoids 120 or as a result of the trimming away of the flat portions 116 of the sheet structure 102, with the exception of the flange sections 122 (see also FIG. 9) as immediately adjacent to an elongate semi-tubular element 104. In at least one embodiment as shown in FIG. 6 the elongate semi-tubular element 104 may include a semi-circular cross sectional shape having a semi-circular internal cavity or resonance space 118. In at least one embodiment, the inclusion of a semi-circular shaped elongate semi-tubular element 104 provides an alternative bracing structure for the soundboard 22, which in turn provides different tone qualities for the musical instrument. In at least one embodiment, the alternative configuration or shape of the internal cavity or resonance spaces 118 within the semi-tubular elements 104 yields different vibrational characteristics for the soundboard 22 providing a different tone or sound for the musical instrument.

Figure 7:
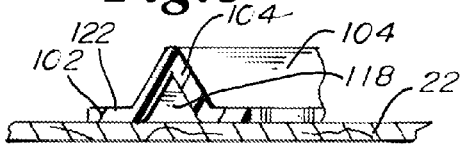
FIG. 7 is an alternative detail partial cross-sectional side view of one embodiment of a bracing structure comprising an elongate semi-tubular element for a soundboard according to the invention.

In at least one embodiment as depicted in FIG. 7, a trimmed sheet structure 102 is disposed on a soundboard 22. The trimmed sheet structure 102 may occur as a result of the inclusion of voids 120 or as a result of the trimming away of the flat portions 116 of the sheet structure 102 with the exception of the flange sections 122 (see also FIG. 9) as immediately adjacent to an elongate semi-tubular element 104. In at least one embodiment shown in FIG. 7, the elongate semi-tubular element 104 may include a triangular cross sectional shape having a triangular shaped internal resonance space 118. In at least one embodiment, the inclusion of a triangular shaped elongate cavity 104 provides an alternative bracing structure for the soundboard 22 yielding different tonal qualities for the musical instrument during use. In at least one embodiment, the alternative configuration/shape for the internal cavity or resonance space 118 provides adjustable vibrational qualities for the soundboard 22.

In at least one embodiment all of the elongate semi-tubular elements 104 may be formed of a common shape having substantially identical internal cavities or resonance spaces 118. In at least one embodiment, one or more elongate semi-tubular elements 104 may include a combination of different shapes and different internal cavities or resonance spaces 118 along the length, or at different locations along the length, of the elongate semi-tubular elements 104.

In at least one embodiment, a bracing pattern formed of elongate semi-tubular elements 104 may be provided, where the elongate semi-tubular elements 104 are individually formed of different shapes, or sections of the pattern of elongate semi-tubular elements 104 are formed of either the same or different shapes. In at least one embodiment an individual elongate semi-tubular element 104 may be formed of one, two, or more different shapes to yield a desired tone for the soundboard 22.

Figure 8:
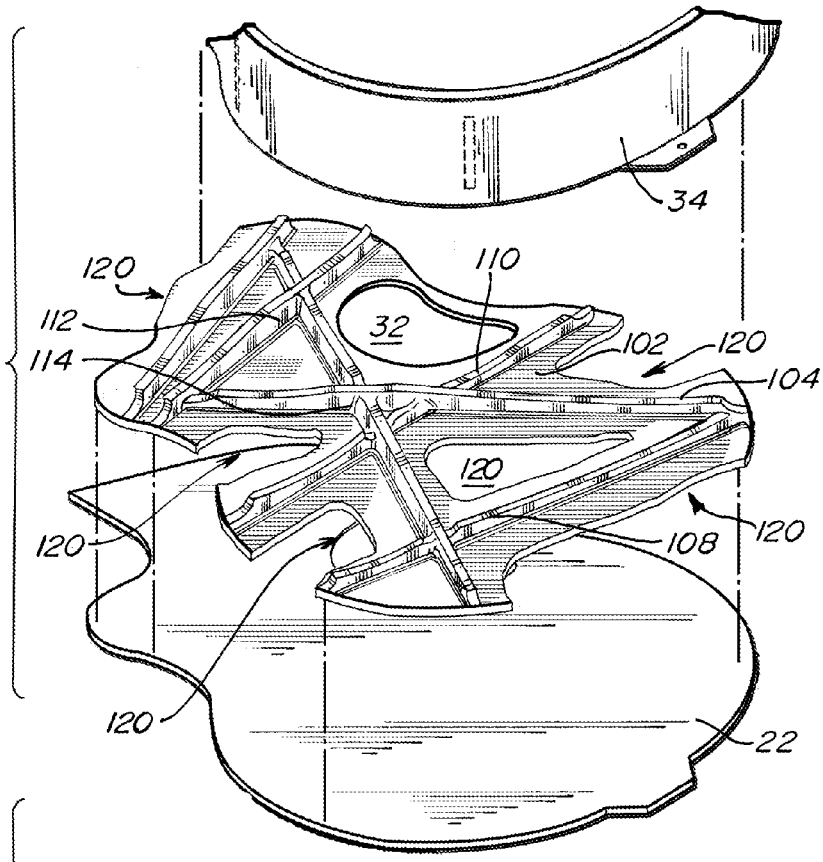
FIG. 8 is a partial exploded isometric view of one embodiment of a soundboard and side wall according to the invention.

In at least one embodiment as depicted in FIG. 8, a soundboard 22 is shown in an exploded view relative to a sheet stricture 102 having elongate semi-tubular elements 104 and void sections 120. A side board 34 is also shown for the attachment about the periphery of the soundboard 22 following receipt of the sheet structure 102.

Figure 9:
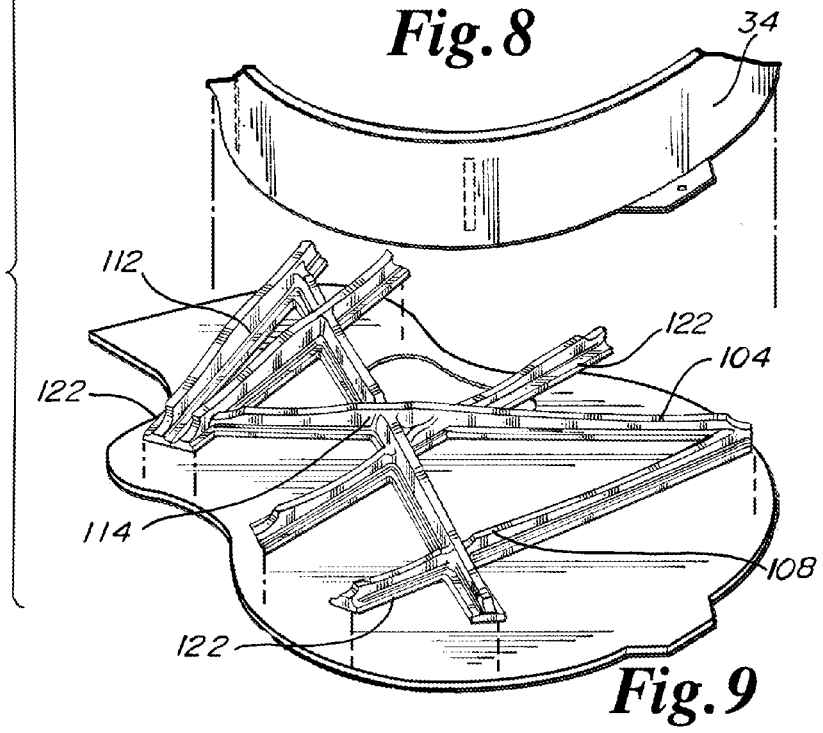
FIG. 9 is an alternative partial exploded isometric view of one embodiment of a soundboard and side wall according to the invention.

In at least one embodiment as depicted in FIG. 9, a soundboard 22 is shown in an exploded view relative to a structure of elongate semi-tubular elements 104 having flanges 122, where the sheet structure 102 has been removed from areas except for locations proximate to the elongate semi-tubular elements 104. The removal of the sheet structure 102 defines the flanges 122. In at least one embodiment, the flanges 122 provide a surface area for attachment of the structure of the elongate semi-tubular elements 104 upon the soundboard 22 through the use of affixation techniques and materials as previously described. A side board 34 is also shown for attachment about the periphery of the soundboard 22 following receipt of the structure of the elongate semi-tubular elements 104.

Figure 10:
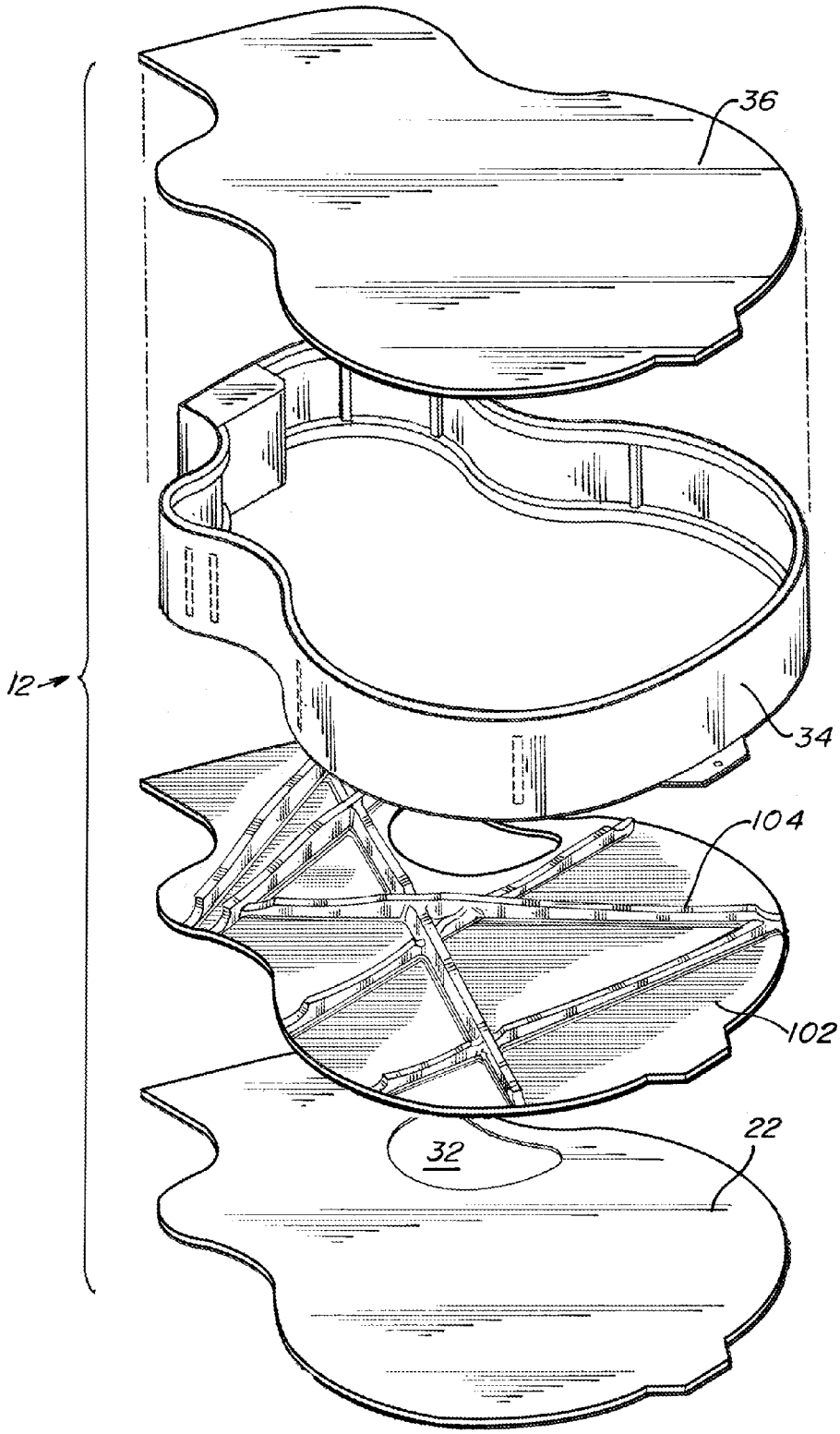
FIG. 10 is an exploded isometric view of one embodiment of a sound box according to the invention.

In at least one embodiment as shown in FIG. 10, a sound box 12 for a musical instrument is shown formed of a soundboard 22 having a sheet structure 102 having elongate semi-tubular elements 104, a side board 34 for attachment about the periphery of the soundboard 22, and a rear panel or bottom board 36 for attachment to the side board 34 to define the internal resonance space for the sound box 12.

In at least one embodiment, any combination and/or pattern of identical or different elongate semi-tubular elements 104 may be utilized within a sheet structure 102, or alternatively with flanges 122, for attachment to either the interior side of the soundboard 22 and/or the interior side of the rear panel/bottom board 36 to form the sound box 12 for a musical instrument.

In at least one alternative embodiment, one or more individual elongate semi-tubular elements 104 may be separately attached to the interior of a soundboard 22. Each individual elongate semi-tubular element 104 may include flanges 122 which may be attached to the interior surface of the soundboard 22, or may be positioned and attached within channels or grooves within the interior surface of the soundboard 22.

In at least one embodiment, one or more elongate semi-tubular elements 104 may be attached to the interior of the soundboard 22 at any desired location and may extend in any desired direction. In other embodiments, two or more elongate semi-tubular elements 104 may be engaged to the interior of the soundboard 22.

In some embodiments, individual elongate semi-tubular elements 104 may contact each other. In other embodiments, individual elongate semi-tubular elements 104 may or may not intersect, or contact each other on the interior of a soundboard 22.

In at least one embodiment the thickness dimension for the walls of the elongate semi-tubular elements 104 may vary along the length of the elongate semi-tubular elements 104, or at certain locations along the length of the elongate semi-tubular elements 104.

In at least one embodiment, two or more elongate semi-tubular elements 104 may be engaged together, sharing a flange 122 at a desired location along the elongate semi-tubular element 104. In some embodiments, the two or more elongate semi-tubular elements 104 may be engaged to each other at any desired angle, or relative to each other at any desire location, on the interior of the soundboard 22. In some embodiments, the flanges 22 and elongate semi-tubular elements 104 form the bracing structure for the soundboard 22.

In at least one embodiment, one or more of the side walls 112 for the semi-tubular elements 104 may be contoured. In certain embodiments, the shape of the contoured side walls 112 may vary along the length of semi-tubular elements 104, and/or may vary between other semi-tubular elements 104 as disposed on the interior of the soundboard 22.

In one embodiment, a stringed instrument comprising, a sound box defining an inner space is provided. The sound box comprises a bottom board, a soundboard and a side wall, the bottom board, soundboard and side wall each having an inner surface which faces the inner space, the side wall being between the bottom board and the soundboard, wherein the bottom board and the soundboard each have a periphery, and the side wall has an upper periphery and a lower periphery, the periphery of the soundboard being connected to the upper periphery and the periphery of the bottom board being connected to the lower periphery. In at least one embodiment, the soundboard comprises a sound hole and a formed unitary structure or sheet structure comprising a plurality of elongate semi-tubular elements facing the inner space, each of the semi-tubular elements having a length, a thickness, a width, a height and an interior resonance space.

In at least one embodiment, the height of said elongate semi-tubular elements varies along the length of said semi-tubular elements. The elongate semi-tubular elements have a first end and a second end, wherein the first ends and the second ends of the elongate semi-tubular elements are each positioned substantially adjacent to the periphery, of the soundboard, and wherein the elongate semi-tubular elements are continuous from their first ends to their second ends. In at least one embodiment, the elongate semi-tubular elements comprise at least two layers of material, wherein one of the at leas WO layers of material is juxtaposed relative to another of the at least two layers.

In at least one embodiment, the elongate semi-tubular elements comprise three layers of material, at least one layer being rotated substantially perpendicular to another of said layers.

In at least one embodiment, at least two of the elongate semi-tubular elements cross each other.

In at least one embodiment, the soundboard comprises a first layer superimposed on a second layer, wherein the first layer faces the inner space, wherein portions of the first layer are removed.

In at least one embodiment, the soundboard has a formed unitary structure where the formed unitary structure is a sheet structure, the sheet structure covering the majority of the first layer.

In at least one embodiment, portions of at least one of the first layer and the second layer of the soundboard are exposed to the inner space through voids in the sheet structure.

In at least one embodiment, a majority of at least one of the first layer and the second layer of the soundboard are exposed to the inner space through voids in the sheet structure.

In at least one embodiment, the bottom board comprises a plurality of elongate semi-tubular elements facing the inner space, wherein the elongate semi-tubular elements have a length, a thickness, a height and a cavity or interior resonance space, wherein the height of the elongate semi-tubular elements varies along their lengths.

In at least one embodiment, the bottom board elongate semi-tubular elements have a first end and a second end, wherein the first ends and the second ends of the bottom board elongate semi-tubular elements are each positioned substantially adjacent to the periphery of the bottom board and wherein the bottom board elongate semi-tubular elements are continuous from their first ends to their second ends.

In at least one embodiment, each of the bottom board elongate semi-tubular elements mirror a soundboard elongate semi-tubular element in positioning and length.

In at least one embodiment, the sound box comprises a plurality of struts attached to the inner surface of the side wall, the struts being generally perpendicular with the soundboard, the struts have first ends and second ends. In at least one embodiment, the first ends of the struts are adjacent to an end of a soundboard elongate semi-tubular element and wherein the second ends of the struts are adjacent to an end of a bottom board elongate semi-tubular element.

In at least one embodiment, the elongate semi-tubular elements are not parallel to one another.

In at least one embodiment, a soundboard for a stringed instrument is provided, the soundboard having: a sound hole and an interior surface; and a formed unitary structure comprising a plurality of elongate semi-tubular elements, each of the semi-tubular elements having a length, a thickness, a width, a height and a cavity or interior resonance space, said formed unitary structure covering at least a portion of the interior surface of the soundboard.

In at least one embodiment, the formed unitary structure may be a sheet structure.

In at least one embodiment, the height of the elongate semi-tubular elements varies along the length of the semi-tubular elements.

In at least one embodiment, the elongate semi-tubular elements have a first end and a second end, wherein the first ends and the second ends of the elongate semi-tubular elements are each positioned substantially adjacent to a periphery of the soundboard and wherein the elongate semi-tubular elements are continuous from their first ends to their second ends.

In at least one embodiment, the elongate semi-tubular elements comprise at least two layers of material where one of the at least two layers of material is juxtaposed relative to another of the at least two layers. In at least one embodiment, the elongate semi-tubular elements comprise three layers of material, at least one layer being rotated substantially perpendicular to another of said layers.

In at least one embodiment, at least two of the elongate semi-tubular elements cross each other.

In at least one embodiment, the sheet structure comprises voids and the elongate semi-tubular elements are not parallel to one another.

In at least one embodiment, the sheet structure is connected to the soundboard.

In at least one embodiment, a majority of the inner surface of the soundboard is exposed through the voids.

In at least one embodiment, one or more individual elongate semi-tubular elements 104 are attached to the soundboard. In at least one embodiment, a plurality of individual elongate semi-tubular elements 104 are attached to a soundboard, wherein the individual elongate semi-tubular elements 104 do not contact one another. Individual elongate semi-tubular elements 104 can be formed using any suitable method, such as molding or pressing of an individual elongate semi-tubular element in the shape of a traditional brace 48.

In at least one embodiment, a method for strengthening a soundboard for a stringed musical instrument is disclosed the method comprises; engaging a traditional bracing device comprising braces to, or within, a structure; covering the traditional bracing device with a releasing agent; applying at least two sheets of material comprising a bonding agent over said traditional bracing device; forming said at least two sheets of material into a unitary structure on said traditional bracing device, said unitary structure comprising a plurality of elongate semi-tubular elements having cavities or interior resonance spaces, said elongate semi-tubular elements being representative of the negative space of the traditional bracing device; removing the unitary structure and elongate semi-tubular elements having cavities or interior resonance spaces from the traditional bracing device; and attaching the unitary structure having the elongate semi-tubular elements having cavities or interior resonance spaces to the interior of a soundboard for a stringed musical instrument.

Other documents and features incorporated in this application include U.S. Pat. No. 6,060,650, U.S. application Ser. No. 09/852,253 and U.S. application Ser. No. 09/567,145.

In addition to being directed to the embodiments described above and claimed below, the present invention is further directed to embodiments having different combinations of the dependent features described above and/or claimed below.

Every patent, application or publication mentioned above is herein incorporated by reference.

The invention contemplates any combination of the above described elements of the stringed instrument. Therefore, it should be understood that multiple inventions are disclosed herein.

The above examples and disclosure are intended to be illustrative and not exhaustive. These examples and description will suggest many variations and alternatives to one of ordinary skill in this art. Further, the particular features presented in the dependent claims can be combined with each other in other manners within the scope of the invention such that the invention should be recognized as also specifically directed to other embodiments having any other possible combination of the features of the dependent claims.

This completes the description of the alternate embodiments of the invention. Those skilled in the art may recognize other equivalents to the specific embodiment described herein which equivalents are intended to be encompassed by the claims attached hereto.

The invention claimed is:

1. A stringed musical instrument bracing device comprising:

a soundboard; and at least one sheet structure engaged to said soundboard, said at least one sheet structure comprising a plurality of formed elongate semi-tubular elements, each of the elongate semi-tubular elements having a length, a width, a height and an interior resonance space.

2. The stringed musical instrument bracing device of claim 1, said sheet structure comprising voids.

3. The stringed musical instrument bracing device of claim 1, wherein said sheet structure is integral with said soundboard.

4. The stringed musical instrument bracing device of claim 1, wherein said plurality of elongate semi-tubular elements are integral with said sheet structure.

5. The stringed musical instrument bracing device of claim 1, wherein said plurality of elongate semi-tubular elements are engaged to said sheet structure.

6. The stringed musical instrument bracing device of claim 1, said plurality of elongate semi-tubular elements comprising sidewalls, said sidewalls being continuous.

7. The stringed musical instrument bracing device of claim 1, said plurality of elongate semi-tubular elements comprising sidewalls, said sidewalls comprising openings.

8. The stringed musical instrument bracing device of claim 1, wherein at least two of said interior resonance spaces define internal cavities being identical in shape.

9. The stringed musical instrument bracing device of claim 1, wherein at least two of said interior resonance spaces define internal cavities having different shapes.

10. The stringed musical instrument bracing device of claim 1, wherein said sheet structure is contoured.

11. The stringed musical instrument bracing device of claim 1, said soundboard comprising a periphery and said sheet structure comprising a peripheral edge.

12. The stringed musical instrument bracing device of claim 11, wherein said peripheral edge of said sheet structure is adjacent to said periphery of said soundboard.

13. The stringed musical instrument bracing device of claim 11, wherein at least a portion of said peripheral edge of said sheet structure is adjacent to said periphery of said soundboard and at least a portion of said peripheral edge of said sheet structure is not adjacent to said periphery of said soundboard.

14. The stringed musical instrument bracing device of claim 2, wherein at least one of said voids is disposed exterior of at least one of said elongate semi-tubular elements.

15. The stringed musical instrument bracing device of claim 2, wherein at least one of said voids is disposed interior of at least one of said elongate semi-tubular elements.

16. The stringed musical instrument bracing device of claim 2, wherein at least one of said voids is regularly shaped.

17. The stringed musical instrument bracing device of claim 2, wherein at least one of said voids is irregularly shaped.

18. The stringed musical instrument bracing device of claim 2, wherein at least one of said voids intersect with at least one of said elongate semi-tubular elements.

19. The stringed musical instrument bracing device of claim 2, wherein at least one of said voids does not intersect with at least one of said elongate semi-tubular elements.

20. The stringed musical instrument bracing device of claim 1, wherein said elongate semi-tubular elements form at least one pattern.

* * * * *